US008342517B2

(12) United States Patent
Kinoshita et al.

(10) Patent No.: US 8,342,517 B2
(45) Date of Patent: Jan. 1, 2013

(54) IMAGE FORMING APPARATUS

(75) Inventors: Hidehiko Kinoshita, Kashiwa (JP); Masaaki Moriya, Moriya (JP); Atsushi Nakagawa, Toride (JP); Mitsuhiro Sugeta, Abiko (JP); Noriaki Adachi, Inzai (JP); Satoshi Atarashi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 12/858,801

(22) Filed: Aug. 18, 2010

(65) Prior Publication Data

US 2011/0049794 A1 Mar. 3, 2011

(30) Foreign Application Priority Data

Aug. 27, 2009 (JP) ..... 2009-196774

(51) Int. Cl.
*B65H 7/02* (2006.01)

(52) U.S. Cl. ..... 271/228; 271/226; 271/227; 271/254

(58) Field of Classification Search ..... 271/228, 271/239, 249, 226, 227, 254
See application file for complete search history.

(56) References Cited

U.S. PATENT DOCUMENTS 5,725,319 A 3/1998 Saito et al.
7,300,054 B2 * 11/2007 Suga et al. ..... 271/228
7,694,962 B2 4/2010 Morya et al.
2002/0017755 A1 2/2002 Dobberstein et al.
2007/0296141 A1 * 12/2007 Inoue ..... 271/226
2009/0033028 A1 * 2/2009 Yahata et al. ..... 271/259
2009/0057994 A1 * 3/2009 Kondo ..... 271/228
2009/0295079 A1 12/2009 Kinoshita et al.
2011/0095472 A1 * 4/2011 Ishikawa et al. ..... 271/10.12

FOREIGN PATENT DOCUMENTS

EP 1170237 A2 1/2002
EP 1170237 A3 1/2003
EP 1170237 B1 7/2006

* cited by examiner

*Primary Examiner* — Michael McCullough
*Assistant Examiner* — Howard Sanders
(74) *Attorney, Agent, or Firm* — Fitzpatrick, Cella, Harper & Scinto

(57) ABSTRACT

The present invention provides a sheet conveying apparatus and an image forming apparatus capable of preventing occurrence of skew feeding when correcting sheet lateral deviation. A pair of lateral-shift correcting rollers 305 to correct positional deviation in the sheet width direction based on positional deviation quantity detected by a lateral-registration detection sensor 204*c* is controlled after controlling a skew feeding correcting roller 203 so as to correct sheet skew feeding based on skew-feeding quantity at a sheet leading edge detected by skew-feeding detection sensors 204*a* and 204*b*. Then, skew-feeding quantity of the sheet leading edge to be detected by the skew-feeding detection sensors 204*a* and 204*b* for correcting skew feeding of the next sheet is adjusted with skew-feeding quantity at the sheet trailing edge detected by the lateral-registration detection sensor 204*c* after positional deviation in the sheet width direction is corrected.

9 Claims, 15 Drawing Sheets

IMAGE FORMING APPARATUS

BACKGROUND OF THE INVENTION

1. Field of the Invention

The present invention relates to an image forming apparatus, and in particular, relates to a configuration to correct skew-feeding and positional deviation in the width direction of a sheet.

2. Description of the Related Art

In the related art, there has been an image forming apparatus such as a copying machine, a printer and a facsimile machine including an image forming portion, a transfer portion to transfer a toner image formed on the image forming portion to a sheet, and a sheet conveying apparatus to convey a sheet to the transfer portion. Some sheet conveying apparatuses include a skew-feeding correction portion to detect sheet skew-feeding quantity and to correct skew-feeding by varying a rotation ratio or a rotation speed of two pairs of conveying rollers arranged in the width direction being perpendicular to the sheet conveying direction. Further, some sheet conveying apparatuses include a lateral-registration correction portion to detect lateral-registration being positional deviation in the width direction of a sheet during conveyance with a sensor until the sheet is conveyed to the transfer portion and to correct the lateral deviation of the sheet by shifting, in the width direction, a pair of conveying rollers to convey the sheet in a state of nipping the sheet. In such a sheet conveying apparatus, the sheet lateral deviation is corrected when conveying the sheet to the transfer portion by shifting the sheet in the width direction with a lateral-registration correction portion after firstly correcting sheet skew-feeding with a skew-feeding correction portion as disclosed in US2002/0017755A1.

In such a sheet conveying apparatus in the related art, when correcting sheet lateral-registration, the pair of conveying rollers is to be on standby at a predetermined position and the pair of conveying rollers is moved in the axial direction corresponding to the sheet deviation quantity after nipping the sheet at the standby position. In this manner, the lateral deviation is corrected. FIGS. 15A to 15D are views illustrating the configuration of the lateral-registration correction portion of the sheet conveying apparatus in the related art. A pair of conveying rollers 305 capable of shifting in the axial direction (i.e., the width direction) and sheets Sa and Sb are illustrated in FIGS. 15A to 15D. For example, the sheet Sa has length of approximate 330 mm in the width direction corresponding to a larger size than a normal A4 or A3 size. The sheet Sb has length of approximate 182 mm in the width direction as being a sheet of B5R size, for example.

Since it is required that the pair of conveying rollers 305 is capable of performing lateral-shift operation as nipping the sheet regardless of the sheet size, the pair of conveying rollers 305 is arranged to be matched to the small-sized sheet Sb as a result. For example, as illustrated in FIGS. 15A to 15D, the pair of conveying rollers 305 is arranged at a position being apart from the center of the sheets Sa and Sb in the width direction by distance x. With this arrangement, in the case of correcting lateral deviation of the sheets Sa and Sb, the pair of conveying rollers 305 is capable of being shifted in the direction of an arrow respectively in a state of nipping at a position being apart from the center of the sheets Sa and Sb in the width direction by distance x. Accordingly, the lateral deviation of the sheets Sa and Sb can be corrected regardless of the sheet size.

Here, in the sheet conveying apparatus in the related art having such a lateral-registration correction portion, when deterioration with time such as wearing occurs at one pair of the conveying rollers 305, imbalance of friction force occurs and lateral-shift force is imbalanced. When the lateral-shift force is imbalanced, slippage occurs between the pair of conveying rollers 305 and the respective sheets Sa, Sb. Accordingly, when the respective sheets Sa and Sb are moved, skew-feeding occurs. Similarly, the lateral-shift force is imbalanced due to variation of friction force depending on sheet material, so that slippage occurs between the pair of conveying rollers 305 and the respective sheets Sa and Sb and skew-feeding occurs with sheet moving.

To address the above issues, the present invention provides an image forming apparatus capable of preventing skew-feeding occurrence accompanied with lateral deviation correction of a sheet.

SUMMARY OF THE INVENTION

An image forming apparatus includes a skew-feeding quantity detection portion configured to detect skew-feeding quantity of a sheet to be conveyed, a skew-feeding correction portion configured to correct skew-feeding of a sheet to be conveyed, a lateral deviation quantity detection portion configured to detect positional deviation quantity in the width direction of a sheet to be conveyed, the direction being perpendicular to the sheet conveying direction, a lateral deviation correction portion configured to correct positional deviation in the width direction of a sheet to be conveyed, and a controlling portion configured to control the skew-feeding correction portion and the lateral deviation correction portion, wherein the controlling portion controls the skew-feeding correction portion so as to correct sheet skew-feeding based on the sheet skew-feeding quantity detected by the skew-feeding quantity detection portion, controls the lateral deviation correction portion so as to correct positional deviation in the width direction of a sheet of which skew-feeding correction is performed at the skew-feeding correction portion based on the positional deviation quantity detected by the lateral deviation quantity detection portion, and adjusts skew-feeding quantity for correcting skew-feeding of the next sheet with the skew-feeding correction portion based on sheet skew-feeding quantity detected by the skew-feeding quantity detection portion after positional deviation in the sheet width direction is corrected by the lateral deviation correction portion.

According to the present invention, with skew-feeding quantity of the upstream edge of a sheet in the sheet conveying direction detected after lateral deviation (i.e., positional deviation) of the sheet is corrected, the skew-feeding quantity to be detected for correcting skew-feeding of the next sheet is adjusted. Accordingly, it is possible to prevent occurrence of sheet skew-feeding accompanied with sheet lateral deviation correction.

Further features of the present invention will become apparent from the following description of exemplary embodiments with reference to the attached drawings.

DESCRIPTION OF THE EMBODIMENTS

Figure 1:
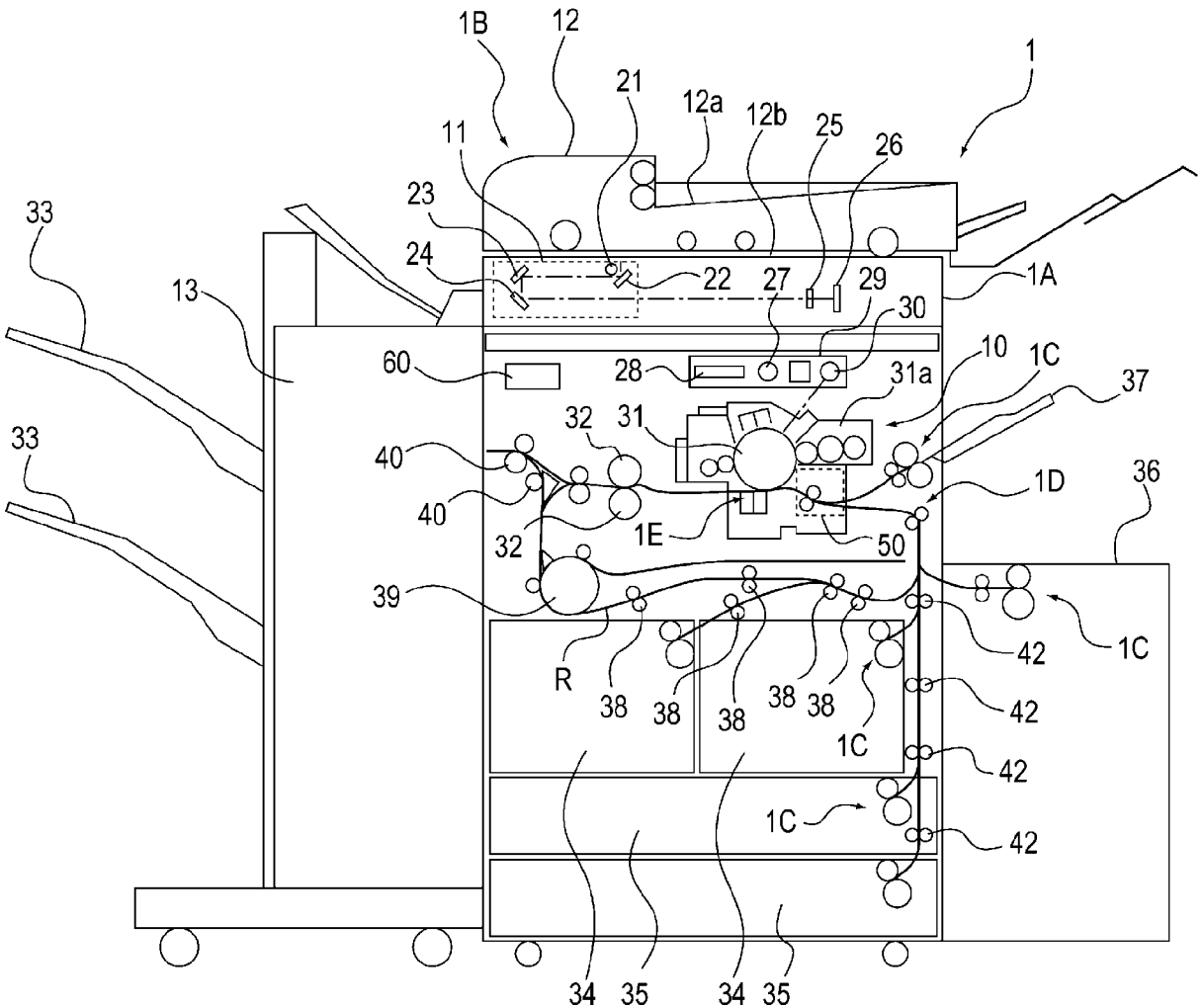
FIG. 1 is a view which illustrates a configuration of a digital copying machine as an example of an image forming apparatus having a sheet conveying apparatus according to a first embodiment of the present invention.

In the following, embodiments of the present invention will be described in detail with reference to the drawings. FIG. 1 is a view illustrating a configuration of a digital copying machine being an example of an image forming apparatus including a sheet conveying apparatus according to the first embodiment of the present invention. FIG. 1 illustrates a digital copying machine 1 and a copying machine body 1A. An image reading apparatus 1B to read an original image is arranged at the upper part of the copying machine body 1A. A sheet processing apparatus 13 to perform processing on a sheet S discharged from the copying machine body 1A is arranged at a side part of the copying machine body 1A.

The image reading apparatus 1B includes a platen glass 12*b* as an original placing platen, a scanner unit 11 to read an original image, and an original feeding apparatus 12 to feed an original to the platen glass 12*b*. The copying machine body 1A includes an image forming portion 10 having a photosensitive drum 31, a sheet feeding portion 1C to feed sheets stored at sheet trays 34 and 35, a sheet conveying apparatus 1D to convey sheets fed by the sheet feeding portion 1C to the image forming portion 10. Here, the sheet conveying apparatus 1D includes a sheet correction portion 50 to correct skew feeding and lateral-registration of a sheet, and plural conveying rollers 38, 39, 42, separately connected to respective stepping motors (not illustrated) as drive sources respectively via a transmission device such as a gear.

Further, a fixing roller 32 to fix a toner image on a sheet and a pair of discharge rollers 40 are arranged at the downstream side of the image forming portion 10. The sheet processing apparatus 13 performs a discharging process to sort sheets output from the copying machine body 1A into plural discharge trays (bins) 33. Here, the plural discharge trays 33 are controlled by a controlling portion (not illustrated) arranged at the sheet processing apparatus 13 or a controller 60 arranged at the copying machine body 1A, so that output sheets are discharged as being sorted into the discharge tray 33 assigned by the controller 60.

In the present embodiment, while the photosensitive drum 31 is driven by a brushless DC motor, the rotation speed of the photosensitive drum 31 and the fixing roller 32 being a process speed is largely affected by shapes and fixing characteristics of toner and laser light emission characteristics. Accordingly, the process speed is characteristic to a digital copying machine and is difficult to be variably controlled. Therefore, a motor capable of outputting sufficient torque to convey thick paper is selected as a drive source of the photosensitive drum 31 and the fixing roller 32. Meanwhile, the conveying rollers 38, 39, and 42 only perform sheet conveyance. Accordingly, when a sheet is not nipped neither at the fixing roller nor at the photosensitive drum 31, the conveying rollers 38, 39, and 42 are controlled to be driven at the highest possible speed. With such high speed driving, the distance between sheets can be set as short as possible so that productivity of the digital copying machine 1 is enhanced.

As illustrated in FIG. 1, a sheet deck 36 to store a number of sheets is arranged beside the copying machine body 1A and a manual sheet tray 37 is arranged at a side of the copying machine body 1A. When feeding a few sheets of an arbitrary type or special sheets such as OHP sheets, thick paper and postcard-sized sheets, an operator uses the manual sheet tray 37. By using the manual sheet tray 37, sheet feeding can be performed relatively easily.

Next, image forming operation with the copying machine body 1A having the above configuration will be described. When a start button (not illustrated) is pressed, originals (not illustrated) stacked on an original tray 12*a* of the original feeding apparatus 12 are sequentially conveyed one by one onto the platen glass 12*b* by the original feeding apparatus 12. When an original is conveyed, a lamp 21 of the scanner unit 11 is turned on and the original is irradiated as the scanner unit 11 is moved by an optical system motor (not illustrated). Reflection light from the original is input to a CCD sensor 26 being an image sensor after passing through a lens 25 via mirrors 22 to 24. The CCD sensor 26 includes elements to convert light into electric signals. According to the operation of the elements, the transmitted optical image is converted into electrical signals and further converted into digital signals (i.e., into image data). The image data of the read original is stored in an image memory (not illustrated) after receiving image processing of various correction processes and imaging processes of user's preference.

Next, the image data is read from the image memory, and then, the image data is reconverted into analog signals from digital signals by an image processing circuit 300 of FIG. 2 which will be described below. Further, the signals are amplified to appropriate output values by a laser control circuit 27 of FIG. 2 and are converted into optical signals by a laser element 202 arranged in a scanner 28 of FIG. 2. The photosensitive drum 31 is irradiated with the optical signals passing via the scanner 28, a lens 29 and a mirror 30, so that an electrostatic latent image is formed on the photosensitive drum 31. Subsequently, by developing the electrostatic latent image with toner, a toner image is formed on the photosensitive drum 31.

Meanwhile, in synchronization with the image forming operation, a sheet is fed by the sheet feeding portion 1C from any of the sheet cassettes 34, 35, the sheet deck 36 and the manual tray 37 and conveyed to the sheet correction portion 50 of the sheet conveying apparatus 1D. Then, the sheet is conveyed to a transfer portion 1E after receiving correction of skew feeding and lateral-registration at the sheet correction portion 50. Next, the toner image is transferred on the sheet at the transfer portion 1E, and then, the sheet having the toner image transferred is conveyed to the fixing roller 32. The toner image is permanently fixed on the sheet as receiving heat and pressure from the fixing roller 32. Subsequently, the image-fixed sheet is discharged from the copying machine body 1A and conveyed to the sheet processing apparatus 13 by the pair of discharge rollers 40. Here, in the case of forming images on both faces of the sheet, the sheet S passing through the fixing roller 32 is reversed by a reverse path R and conveyed to the image forming portion 10 (i.e., the transfer portion 1E) once again to form an image on the rear face. Then, the sheet is conveyed to the sheet processing apparatus 13 by the pair of discharge rollers 40.

Figure 2:
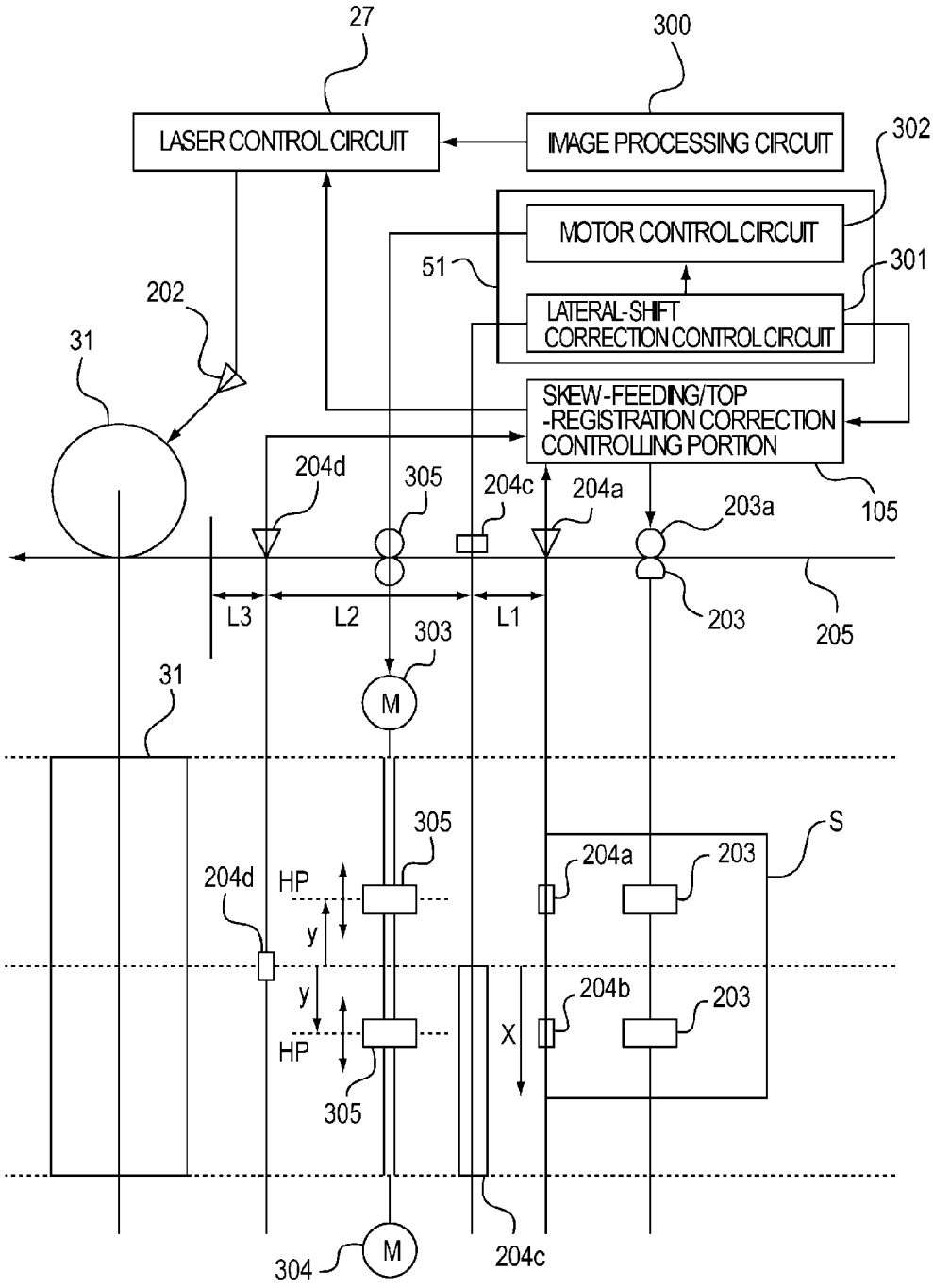
FIG. 2 is a view which illustrates a configuration and control blocks of a sheet correction portion arranged in the sheet conveying apparatus.

FIG. 2 is a view illustrating the configuration and control blocks of the sheet correction portion 50 arranged at the upstream side of the photosensitive drum 31 in the sheet conveying direction. FIG. 2 illustrates a sheet conveying path 205, a skew-feeding correcting roller 203 to correct skew feeding of a sheet, and a driven roller 203*a* constituting a skew-feeding correction portion along with the skew-feeding correcting roller 203 driven to be rotated with the skew-feeding correcting roller 203. Two of (i.e., a pair of) the skew-feeding correcting rollers 203 are arranged in the width direction being perpendicular to the sheet conveying direction. The skew-feeding rollers 203 constituting a pair of rotating members are controlled respectively by separate stepping motors. A part of the circumferential face of each skew-feeding correcting roller 203 is formed to be cutout-shaped. During standby for sheet conveyance after skew-feeding correction is completed, the cutout portion is directed upward so that clearance is formed with the driven roller 203*a* located thereabove. Accordingly, during later-mentioned lateral-shift operation, the skew-feeding correcting roller 203 is continuously in a state of being apart from a sheet so as not to disturb the lateral-shift operation.

Skew-feeding detection sensors 204*a* and 204*b* constitute a downstream edge skew-feeding quantity detection portion to detect skew-feeding quantity at the sheet leading edge being the downstream edge in the sheet conveying direction of a sheet fed to the sheet conveying path 205. The sheet skew feeding is corrected by the skew-feeding correcting roller 203 corresponding to the skew-feeding quantity at the sheet leading edge detected by the skew-feeding detection sensors 204*a* and 204*b*. With the above configuration, the sheet S conveyed along the sheet conveying path 205 can be fed to the photosensitive drum side without being temporally stopped. As illustrated in FIG. 2, a plurality of (i.e., two of) the skew-feeding detection sensors 204*a* and 204*b* are arranged in the width direction and are connected to a skew-feeding/top-registration correction controlling portion 105. When either of the skew-feeding detection sensors 204*a* and 204*b* detects the leading edge of the sheet S, the skew-feeding/top-registration correction controlling portion 105 calculates skew-feeding quantity based on the detection signal and starts to drive the skew-feeding correcting roller 203 based thereon.

Figure 3:
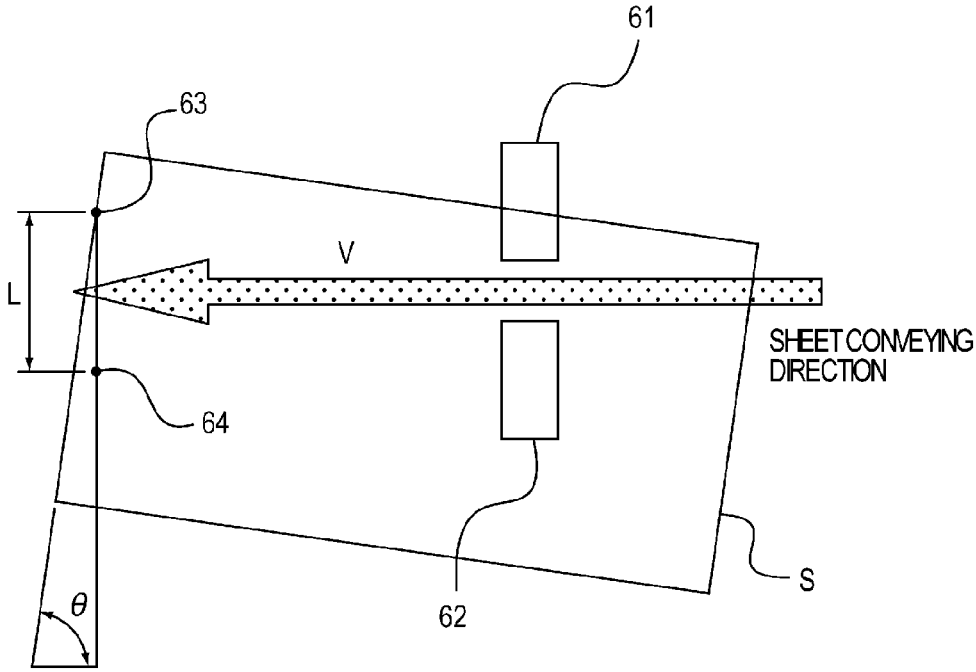
FIG. 3 is an explanatory view of a skew-feeding quantity calculation method of a sheet at the sheet correction portion.

FIG. 3 is an explanatory view of a skew-feeding quantity calculation method of a sheet S utilizing two sensors. FIG. 3 illustrates first and second optical sensors 63 and 64 of a reflection type and skew-feeding correcting rollers 61 and 62. When the sheet S is conveyed in a state of FIG. 3, the second optical sensor 64 firstly detects passing of the sheet S, and then, the first optical sensor 63 detects passing of the sheet S. Here, the skew-feeding rollers 61 and 62 are driven respectively by a pulse motor. Accordingly, the conveying speed of the sheet S can be calculated from a step angle and timing of pulse outputting. Further, by detecting timing of passing the sheet S with the first and second optical sensors 63 and 64, the skew-feeding quantity of the sheet S can be calculated.

The sheet skew-feeding angle θ is expressed as follows:

$$\theta=\tan^{-1}(L/V\cdot T)$$

Here, L denotes distance between the optical sensors 63, 64, V denotes a sheet conveying speed, and T denotes a time from sheet detection by the second optical sensor 64 to sheet detection by the first optical sensor 63.

The skew-feeding/top-registration correction controlling portion 105 corrects skew feeding of the sheet S by controlling rotation of two of the skew-feeding correcting rollers 203 based on the skew-feeding quantity of the sheet S acquired as described above. In the present embodiment, the skew feeding of the sheet S is corrected with a difference of a sheet conveying speed of the skew-feeding rollers 203 being the two (i.e., plural) rotating members caused by varying a rotation ratio or a rotation speed thereof. Further, it is possible that the skew-feeding/top-registration correction controlling portion 105 offsets (i.e., adjusts) the skew-feeding quantity of the sheet S based on data from a lateral-shift correction control circuit 301 as described later.

FIG. 2 illustrates a lateral-registration detection sensor 204*c* being a lateral-registration quantity detection portion to detect a side edge position of a sheet in the width direction. The lateral-registration detection sensor 204*c* also functions as an upstream edge skew-feeding quantity detection portion to detect skew-feeding quantity of the sheet trailing edge being the upstream edge in the sheet conveying direction after the lateral-shift operation. The lateral-registration detection sensor 204*c* adopts CCD or CIS being an image reading sensor (i.e., an image sensor) to read an image. In the present embodiment, CIS is adopted. A leading edge detection sensor 204*d* detects a leading edge position of a sheet after performing the lateral-deviation correction of the sheet. The controller 60 (see FIG. 1) maintains synchronization with image generation timing signals based on the sheet position detection signals from the leading edge detection sensor 204*d*.

The lateral-registration sensor 204*c* is located at the photosensitive drum side from the skew-feeding detection sensors 204*a* and 204*b* by distance L1. The leading edge detection sensor 204*d* is located at the photosensitive drum side from the skew-feeding detection sensors 204*a* and 204*b* by distance L1+L2. When the image forming operation is performed, the sheet fed in a state that skew feeding is corrected by the skew-feeding correcting roller 203 is conveyed toward the photosensitive drum 31 along the sheet conveying path 205 as described above. At that time, in order to adjust a writing position, it is necessary to detect conveyance timing of the sheet S in the conveying direction and to control adjusting of a writing position with laser light. In the present embodiment, the controller 60 controls to start writing with laser when the sheet proceeds by distance L3 after the leading edge position of the sheet is detected by the leading edge detection sensor 204*d*. In this manner, the image writing position in the sheet conveying direction can be adjusted.

A pair of lateral-shift correcting rollers (hereinafter, called a pair of lateral-registration rollers) 305 is a pair of conveying rollers capable of conveying a sheet and shifting in the width direction in a state of nipping the sheet. Plural (i.e., two) pairs of the lateral-registration rollers 305 are arranged coaxially in the width direction. The pair of lateral-registration rollers 305 is shifted in the width direction by a lateral shift motor 303 in a state of nipping a sheet corresponding to the lateral deviation quantity detected by the lateral-registration detection sensor 204*c*. A conveying motor 304 rotates the pair of lateral-registration rollers 305 in the sheet conveying direction. The pair of lateral-registration rollers 305 is capable of conveying a sheet while shifting in the width direction with the conveying motor 304 and the lateral shift motor 303. Here, the conveying motor 304 and the lateral shift motor 303 constituting a lateral deviation correction portion to correct positional deviation of a sheet in the width direction along with the pair of lateral-registration rollers 305 are stepping motors and connected to the pair of lateral-registration rollers 305 via a transmission device such as a gear device (not illustrated).

Figure 15A:
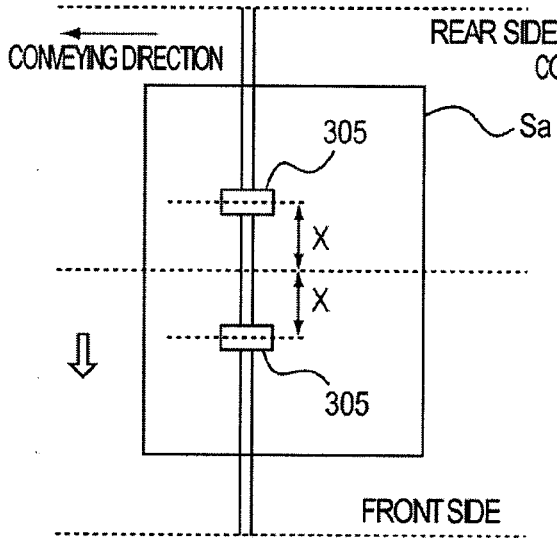
FIG. 15A PRIOR ART
FIGS. 15A to 15D are views which illustrate a configuration of a lateral-registration correction portion of a sheet conveying apparatus in the related art.
Figure 15B:
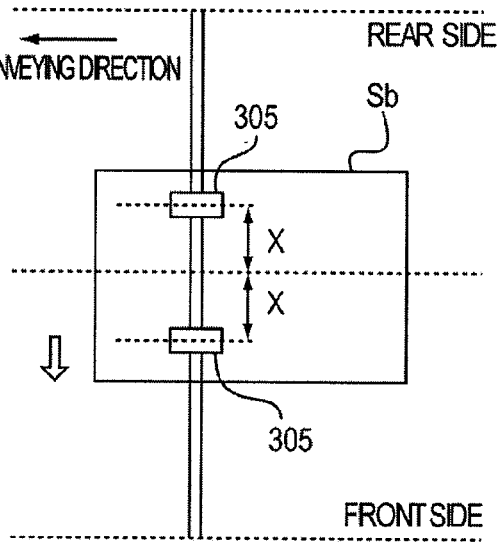
FIG. 15B PRIOR ART
Figure 15C:
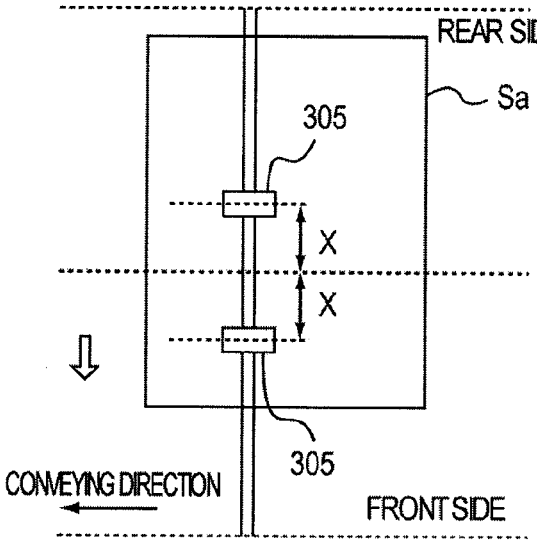
FIG. 15C PRIOR ART
Figure 15D:
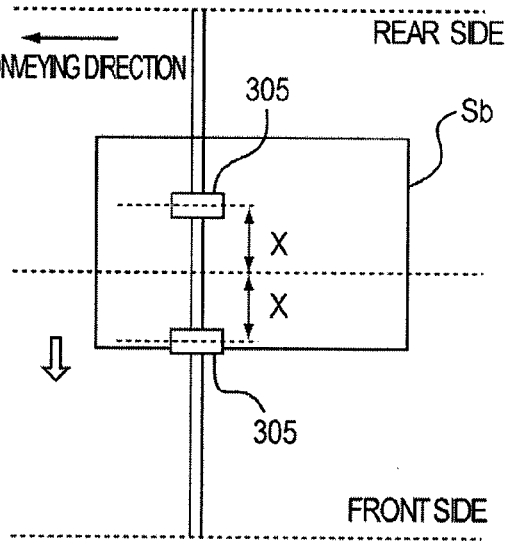
FIG. 15D PRIOR ART

The pair of lateral-registration rollers 305 are on standby at a position being apart by y in the width direction from the center of the sheet conveying path 205 in the width direction (hereinafter, called the conveyance center) due to a home position (HP) sensor (not illustrated) before performing the lateral-shift correction. Here, the standby position is set to a position (see FIGS. 15A and 15B) where either of a large-sized sheet and a small-sized sheet can be conveyed in the case that lateral deviation does not occur and lateral-shift correction is not required in actual operation. In the present embodiment, the HP position is set to be apart by y from the conveyance center of the sheet conveying path 205. However, not limited to this, the HP position may be set to be apart by a predetermined distance from an edge part of the sheet conveying path 205.

In the case that the lateral-registration adjustment is performed, the lateral-registration detection sensor 204*c* firstly detects a side edge position of a sheet S, so that the lateral deviation quantity (i.e., the lateral-registration quantity) Δx is detected through the detected position. Specifically, by detecting which position of the lateral-registration detection sensor 204*c* the sheet S passes, the lateral deviation quantity Δx is detected and the lateral-shift quantity is calculated based thereon. Then, the lateral-registration correction is performed by shifting the pair of lateral-registration rollers 305 by the calculated lateral-shift quantity.

Figure 4:
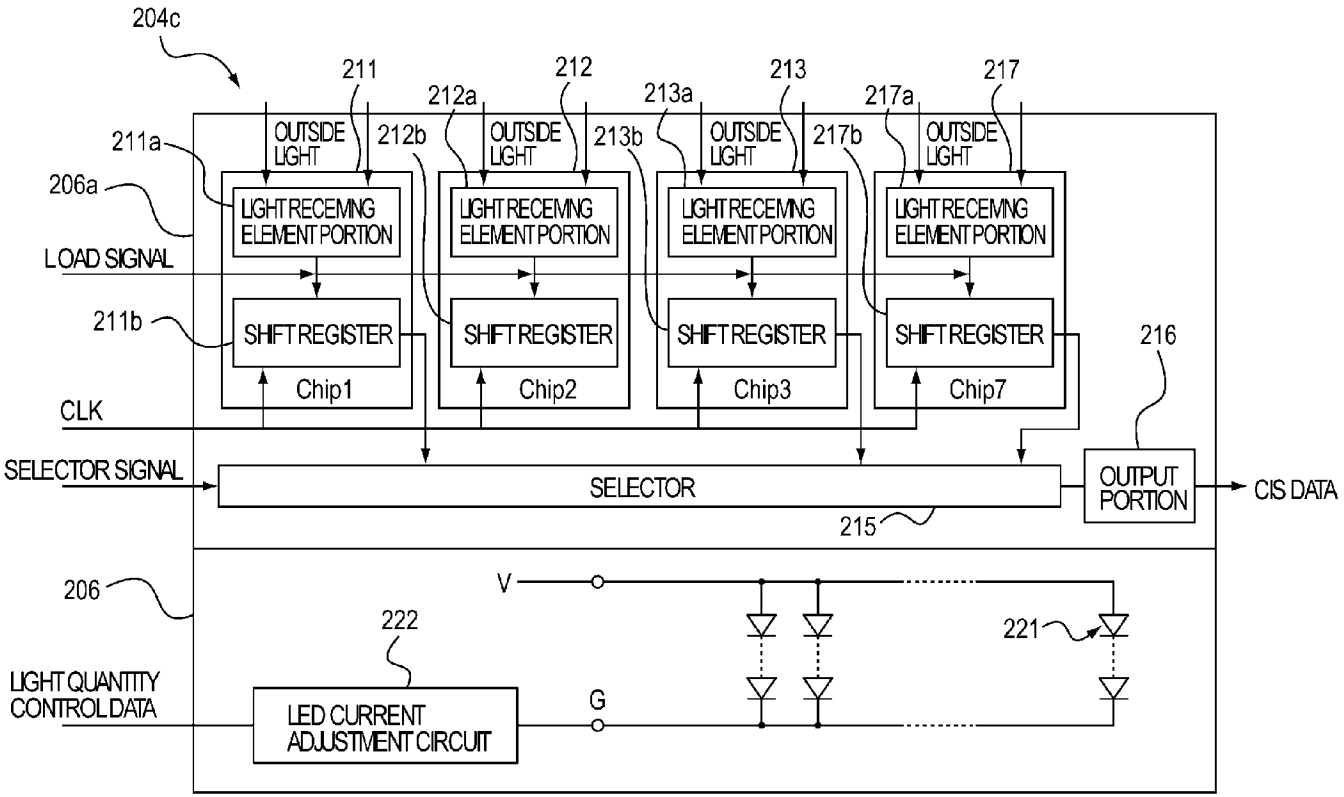
FIG. 4 is a view which illustrates a configuration of a lateral-registration detection sensor arranged at the sheet correction portion.

FIG. 4 is a view illustrating the configuration of the lateral-registration detection sensor 204*c* utilizing CIS. As illustrated in FIG. 4, the lateral-registration detection sensor 204*c* includes an image reading portion 206*a* and an LED emitting portion 206. The image reading portion 206*a* includes plural (i.e., seven in the present embodiment) chips 211 to 217 respectively having a light receiving element portions 211*a* to 217*a* and shift registers 211*b* to 217*b* in one chip, a selector 215 and an output portion 216. Reading pixels of 1000 pieces are arranged respectively at each of the light receiving element portions 211*a* to 217*a* in the respective chips.

Among the reading pixels of an effective pixel number of 7000 pieces in the entire sensor, the reading pixels of 1000 pieces in the chip 211 (i.e., Chip 1) located at the top are used for reading in the sub-scanning direction (i.e., for the trailing edge skew-feeding detection). That is, in the present embodiment, sheet skew feeding after the lateral-shift operation is detected by the chip 211 (i.e. Chip 1). Meanwhile, the reading pixels of 6000 pieces in the remaining six chips 212 to 217 (i.e., Chip 2 to Chip 7) are used for reading in the main scanning direction (i.e., for later-described side edge detection). Here, the effective pixel number being the sum of the plural chips is simply an example and is not limited thereto. The effective pixel number may be an arbitrary number. Further, regarding the split of chips, not limited to a ratio of 1 to n−1 as in the present embodiment, arbitral split ratio may be adopted.

The selector 215 selects specific one or more chips with a selector signal from the lateral-shift correction control circuit 301 of FIG. 2. For example, at the time of trailing edge skew-feeding detection, the selector 215 selects only the chip 211 to be effective. When the selector 215 selects only the chip 211 to be effective as described above, the image signals detected by the light receiving element portion 211*a* are once read to the shift register 211*b* based on a load signal (CIS-SH) from the lateral-shift correction control circuit 301. Subsequently, the image signals are sequentially transferred to the output portion 216 via the selector 215 from the shift register 211*b* corresponding to a clock (CLK) from the lateral-shift correction control circuit 301. The output portion 216 converts the transferred serial image signals into parallel data and outputs as CIS data (i.e., the lateral-registration data).

Further, there is a case that the selector 215 selects the chips 212 to 217 to be effective used for the side edge detection with a selector signal from the lateral-shift correction control circuit 301. In this case, the image signals detected by respective light receiving element portions 212*a* to 217*a* are once read to the shift registers 212*b* to 217*b* based on load signals from the lateral-shift correction control circuit 301. Subsequently, the image signals are sequentially transferred to the output portion 216 via the selector 215 from the shift registers 212*b* to 217*b* corresponding to a clock (CLK) from the skew-feeding/top-registration correction controlling portion 105. The output portion 216 converts the transferred serial image signals into parallel data and outputs the parallel data as CIS data.

Meanwhile, the LED emitting portion 206 includes an LED portion 221 to which plural LED groups being serially connected are connected in parallel and an LED current adjustment circuit 222 which is connected to a cathode side of each LED group and which adjusts current flowing through each LED group. Here, the LED current adjustment circuit 222 adjusts the entire LED emission quantity of the LED portion 221 based on light quantity control data from the lateral-shift correction control circuit 301.

Figure 5:
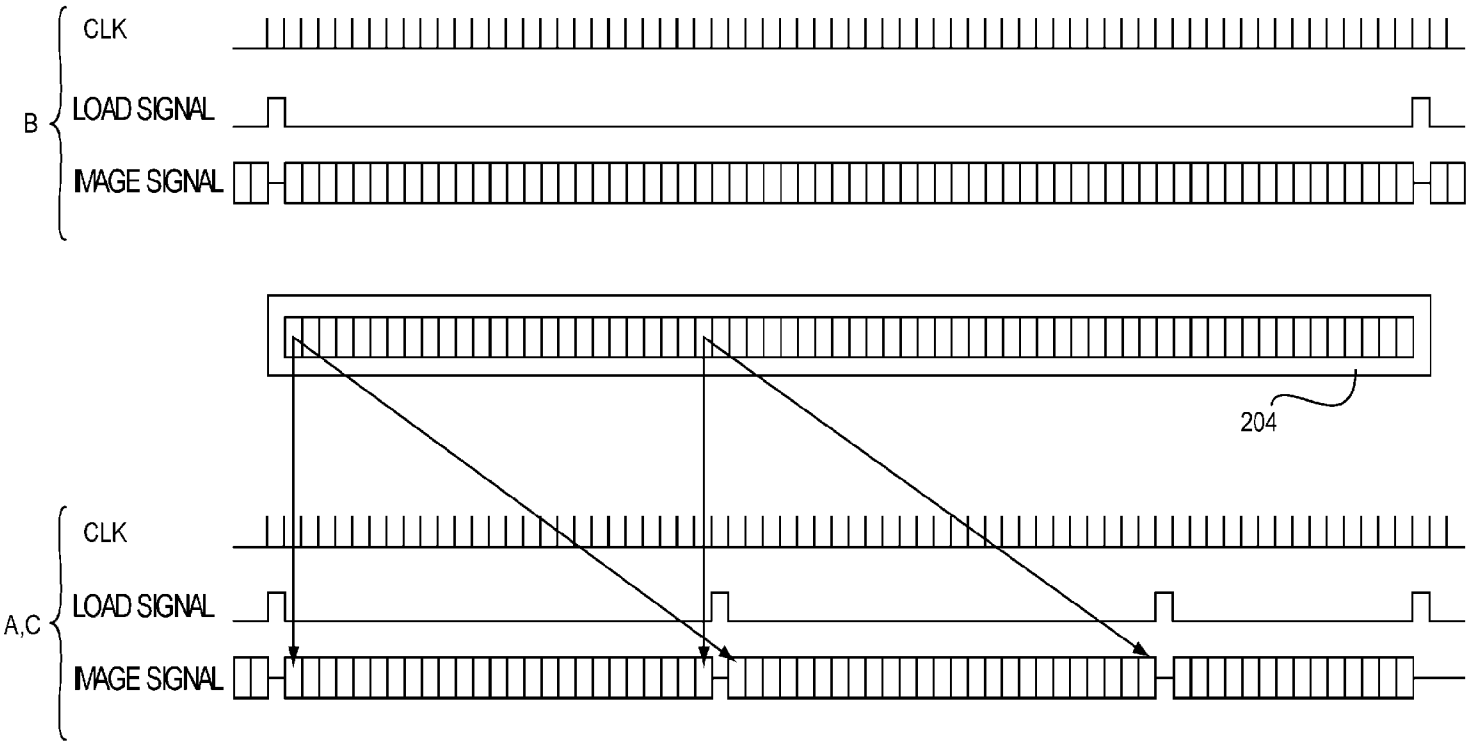
FIG. 5 is a timing chart of the lateral-registration detection sensor.

FIG. 5 is a timing chart illustrating variation of the clock (CLK) of the lateral-registration detection sensor 204*c*, the load signal (CIS-SH) and the image signal when performing the leading edge detection, the skew-feeding detection and the side edge detection. In the case of the trailing edge skew-feeding detection ("A" in FIG. 5), the light receiving element portion 211*a* to be used is for one chip. Therefore, a charge accumulation time for repeated reading with the load signal becomes short. In this case, the LED current value is set high by the LED current adjustment circuit 222 to increase the LED emission quantity corresponding to the light quantity control data from the lateral-shift correction control circuit 301, so that the S/N ratio of the read image is prevented from being decreased. Meanwhile, in the case of side edge detection ("B" in FIG. 5), since six of the light receiving element portions 212*a* to 217*a* are used, the charge accumulation time for repeated reading with the load signal becomes relatively long. In this case, even though the LED current value is set low by the LED current adjustment circuit 222 to decrease the LED emission quantity according to the light quantity control data from the lateral-shift correction control circuit 301, the S/N ratio of the read image can be maintained.

Figure 6:
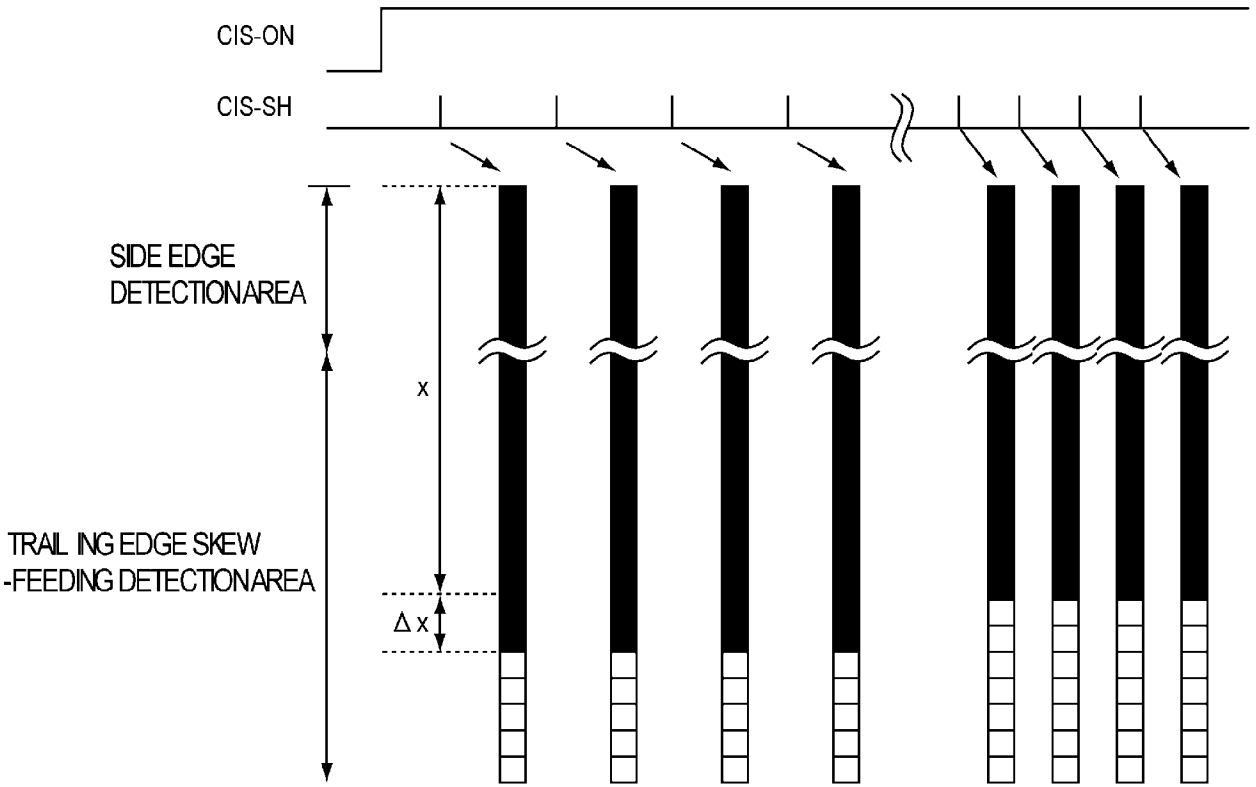
FIG. 6 is an explanatory view which illustrates an area of the lateral-registration detection sensor for sheet detection.

FIG. 6 is an explanatory view of detecting the sheet lateral deviation quantity by the lateral-registration detection sensor 204*c*. When the lateral-registration detection sensor 204*c* is driven with the CIS-ON signal, the lateral-registration detection sensor 204*c* performs data reading. Accordingly, data is read according to timing of CIS-SH. Then, the lateral deviation quantity Δx occurring from the ideal value x without lateral variation is detected from the read data. In this case, Δx is acquired by averaging data of a predetermined number of lines.

Figure 7:
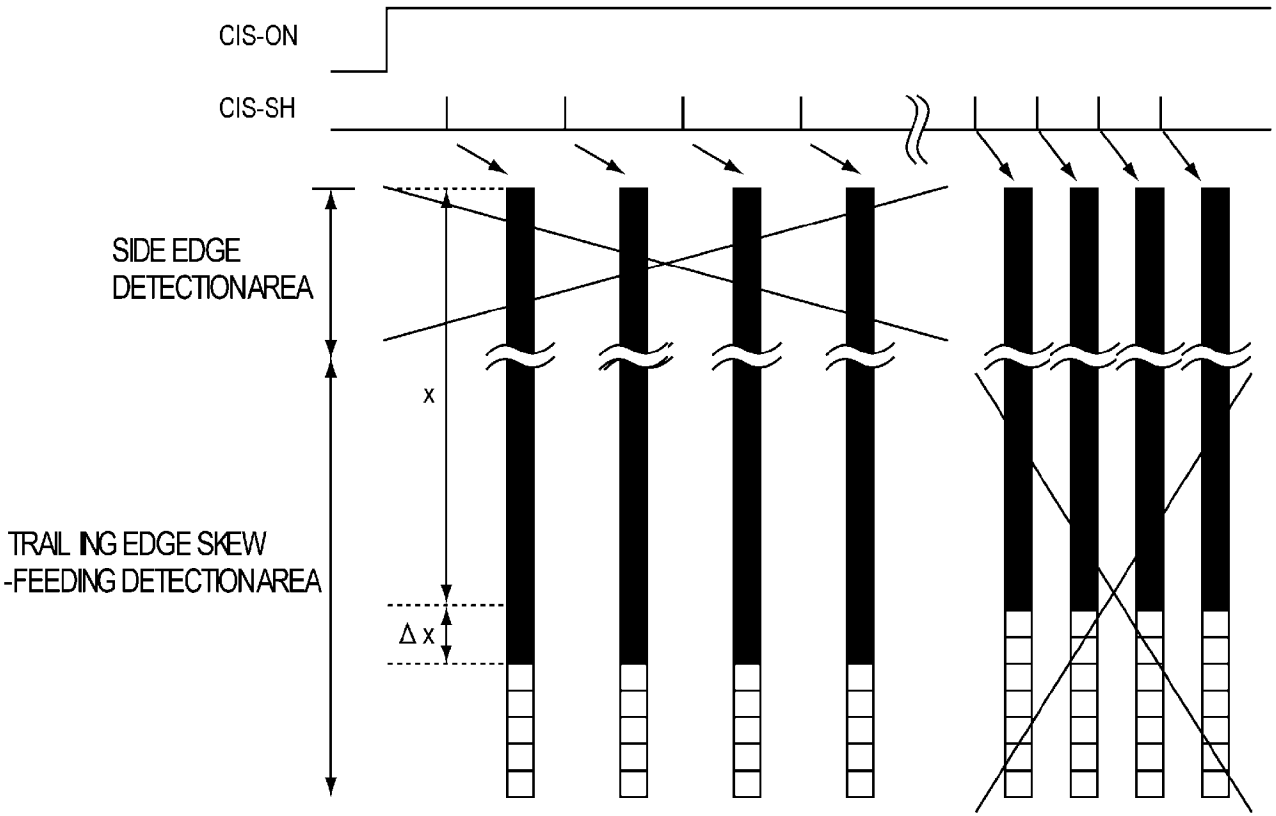
FIG. 7 is another explanatory view which illustrates an area of the lateral-registration detection sensor for sheet detection.

FIG. 7 is a view illustrating a leading edge detection area and a side edge detection area of the lateral-registration detection sensor 204*c*. The leading edge (skew-feeding) detection area corresponds to 1000 pixels included in the light receiving element portion 211*a* in the lateral-registration detection sensor located at the approximate center side of the sheet S, as described above. During the leading edge (skew-feeding) detection is performed, the remaining reading element pixels in the lateral-registration detection sensor are not used as illustrated with "x" in FIG. 7. Meanwhile, the side edge detection area corresponds to 6000 pixels included in the remaining light receiving element portions 212*a* to 217*a* in the lateral-registration detection sensor 204*c*. During the side edge detection is performed, 1000 pixels of the light receiving element portion 211*a* used for the leading edge detection are not used as illustrated with "x" in FIG. 7. As described above, the present embodiment adopts a process to take only necessary pixel data of the reading pixels of the lateral-registration detection sensor 204*c* being appropriate respectively for the leading edge detection and the side edge detection preferably not to take unnecessary data for respective detection.

Figure 8:
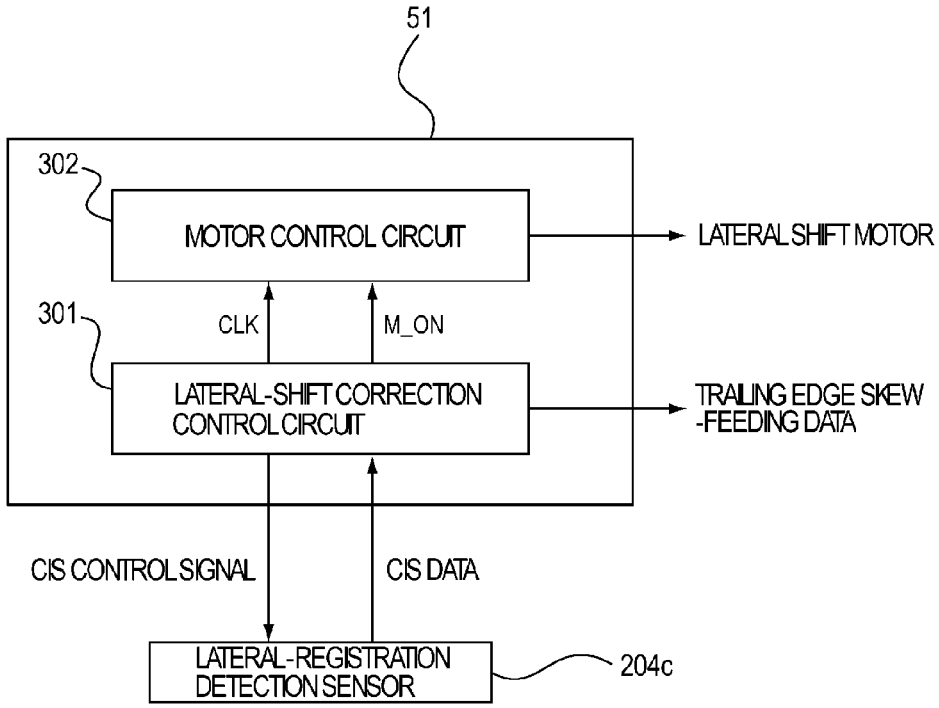
FIG. 8 is a block diagram which illustrates a configuration of a lateral-registration controlling portion arranged at the sheet correction portion.

In FIG. 2, a lateral-registration controlling portion 51 performs the lateral-registration correction control. As illustrated in FIG. 8, the lateral-registration controlling portion 51 includes the lateral-shift correction control circuit 301 and a motor control circuit 302. Along with the skew-feeding/top-registration correction controlling portion 105, the lateral-registration controlling portion 51 constitutes a controlling portion to control a sheet conveying speed of the skew-feeding correcting roller 203 so as to correct sheet skew feeding based on the skew-feeding quantity detected by the skew-feeding detection sensors 204*a* and 204*b*. Further, the lateral-registration controlling portion 51 constitutes a controlling portion to control the pair of lateral-registration rollers 305 so as to correct positional deviation in the sheet width direction based on the positional deviation quantity detected by the lateral-registration detection sensor 204*c*. Furthermore, the lateral-registration controlling portion 51 constitutes a controlling portion to adjust the skew-feeding quantity detected when skew feeding of the next sheet is corrected based on the skew-feeding quantity of the sheet trailing edge detected by the lateral-registration detection sensor 204*c*. Here, the lateral-registration controlling portion 51 and the skew-feeding/top-registration correction controlling portion 105 may be arranged respectively in a dedicated manner. Alternately, the controller 60 illustrated in FIG. 1 may function as the lateral-registration controlling portion 51 and the skew-feeding/top-registration correction controlling portion 105 as well.

The motor control circuit 302 being a lateral-shift drive controlling portion outputs a drive signal to the lateral shift motor based on an output signal corresponding to the lateral deviation quantity calculated by the lateral-shift correction control circuit 301 being a lateral deviation quantity detection portion. The lateral-shift correction control circuit 301 outputs a lateral-registration detection portion control signal (i.e., a CIS control signal) to the lateral-registration detection sensor 204*c*. Further, the lateral-shift correction control circuit 301 receives input of the lateral-registration data (i.e., the CIS data) read by the lateral-registration detection sensor 204*c* and calculates (i.e., detects) the lateral deviation quantity based on the lateral-registration data. Then, the lateral-shift correction control circuit 301 outputs a motor-ON (M_ON) signal and CLK to the motor control circuit 302. Similarly, the lateral-shift correction control circuit 301 receives input of the trailing edge skew-feeding detection data (i.e., the CIS data) read by the lateral-registration detection sensor 204*c* and outputs the trailing edge skew-feeding data to the skew-feeding/top-registration correction controlling portion 105.

Figure 9:
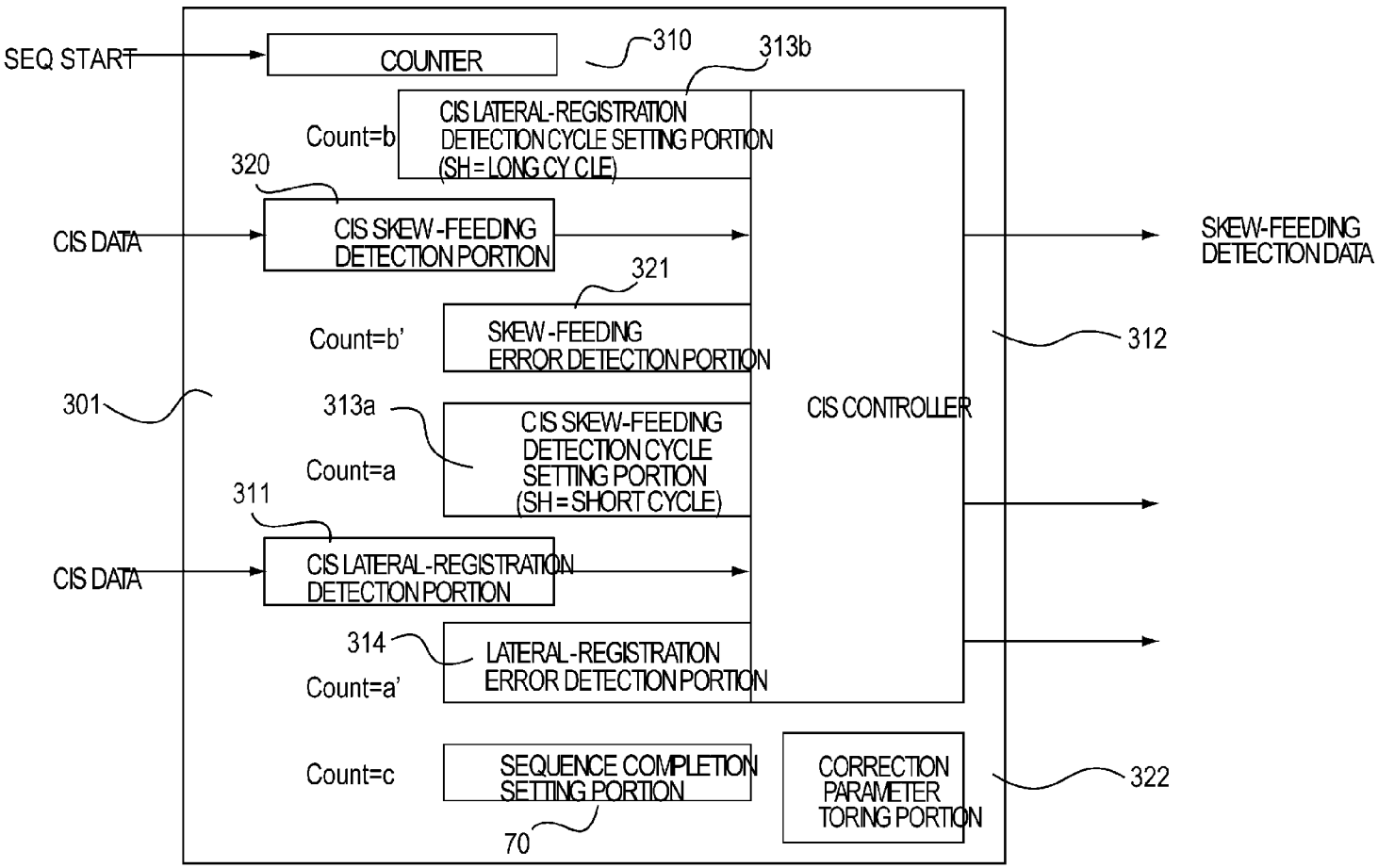
FIG. 9 is a block diagram which illustrates a configuration of a lateral-shift correction control circuit arranged at the lateral-registration controlling portion.

FIG. 9 is a block diagram illustrating the configuration of the lateral-shift correction control circuit 301. The lateral-shift correction control circuit 301 includes a counter 310, a CIS lateral-registration detection portion 311, a CIS controller 312, a CIS lateral-registration detection cycle setting portion 313*a*, and a lateral-registration error detection portion 314. Further, the lateral-shift correction control circuit 301 includes a sequence completion setting portion (SEQ END) 70, a CIS skew-feeding detection portion 320, a skew-feeding error detection portion 321, a CIS skew-feeding detection cycle setting portion 313*b*, and a correction parameter storing portion 322. Here, the counter 310 starts with a sequence start signal (SEQ START) and counts a constant cycle clock. The CIS lateral-registration detection portion 311 detects a lateral-registration position of a sheet based on the lateral-registration data (i.e., the CIS data) input from the lateral-registration detection sensor 204*c*.

The CIS skew-feeding detection portion 320 performs detection and calculation of the sheet leading edge skew-feeding quantity and the sheet trailing edge skew-feeding quantity based on the CIS data input from the lateral-registration detection sensor 204*c* and outputs the calculated skew-feeding quantity to the skew-feeding/top-registration correction controlling portion 105. The CIS controller 312 outputs the load signal (CIS-SH), the clock (CIS-CLK), the motor drive signal (M_ON), and the selector signal to the lateral-registration detection sensor 204*c*. Further, the CIS controller 312 outputs a control signal for the lateral-registration and trailing edge skew-feeding detection sensor such as the light quantity control data and the skew-feeding detection data. A long cycle TL of the load signal (CIS-SH) input to the lateral-registration detection sensor 204*c* when performing sheet lateral-registration detection is set at the CIS lateral-registration detection cycle setting portion 313*a*. A short cycle TS of the load signal (CIS-SH) input to the lateral-registration detection sensor 204*c* when performing sheet skew-feeding detection is set at the CIS skew-feeding detection cycle setting portion 313*b*.

The lateral-registration error detection portion 314 generates an error signal (ERR) when the side edge position detected by the CIS lateral-registration detection portion 311 is to be out of a predetermined range (for example, 15 mm). Similarly, the skew-feeding error detection portion 321 generates an error signal (ERR) when the sheet leading edge position detected by the CIS skew-feeding detection portion 320 is to be out of a predetermined range (for example, 15 mm). A count value of the sequence to complete printing of one sheet is set at the sequence completion setting portion (SEQ END) 70.

Figure 10:
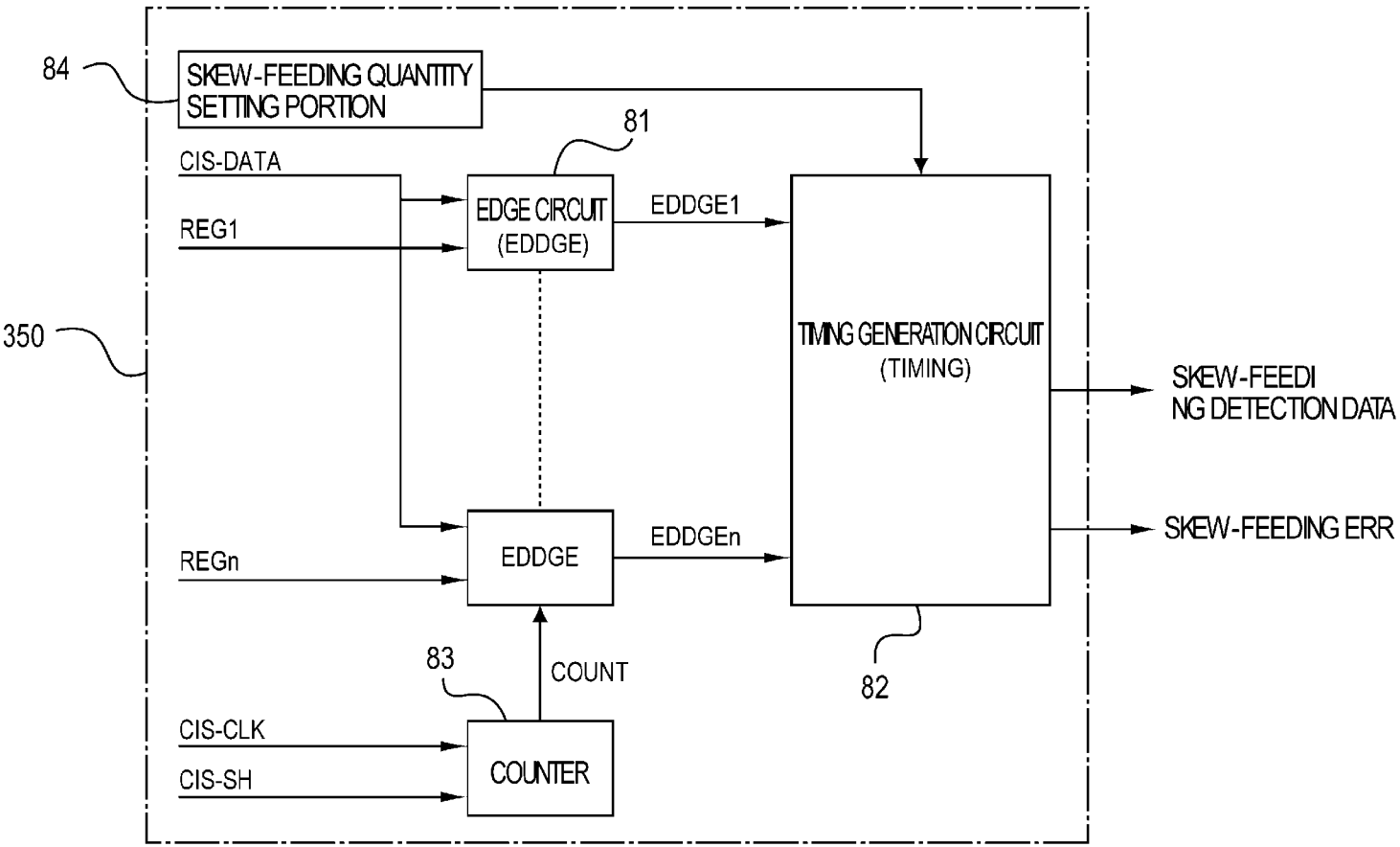
FIG. 10 is a block diagram which illustrates a configuration of a trailing edge skew-feeding detection portion.

Incidentally, the CIS skew-feeding detection portion 320 includes a leading edge skew-feeding detection portion (not illustrated) to detect the skew-feeding quantity at the sheet leading edge and a trailing edge skew-feeding detection portion to detect the skew-feeding quantity at the sheet trailing edge of FIG. 10, based on the CIS data input from the lateral-registration detection sensor 204*c*. Here, as illustrated in FIG. 10, the trailing edge skew-feeding detection portion 350 includes plural edge circuits (EDDGE) 81, a timing generation circuit 82, a counter 83, and a skew-feeding quantity setting portion 84. Each edge circuit (EDDGE) 81 receives input of a register signal (REG1 to REGn) assigning a pixel position in the light receiving element portion 211*a* of the lateral-registration detection sensor 204*c* along with the CIS data. When "variation from sheet absence to sheet presence"

is detected at the assigned pixel position in synchronization with the count signal of the counter 83, the edge circuits (EDGE) 81 generate edge signals (EDGE1 to EDGEn). The timing generation circuit 82 calculates and detects the skew-feeding quantity by utilizing the plural generated edge signals (EDDGE1 to EDGEn) and outputs the skew-feeding detection data (i.e., the trailing edge skew-feeding data) to the skew-feeding/top-registration correction controlling portion 105. Here, in the case that the detected skew-feeding quantity is larger than the skew-feeding quantity (REG: 15 mm) previously set at the skew-feeding quantity setting portion 84, skew-feeding error signal (skew-feeding ERR) is output to the skew-feeding/top-registration correction controlling portion 105. The counter 83 outputs a counter signal to the plural edge circuit (EDGE) 81 based on the load signal (CIS-SH) and the clock (CIS-CLK).

Figure 11:
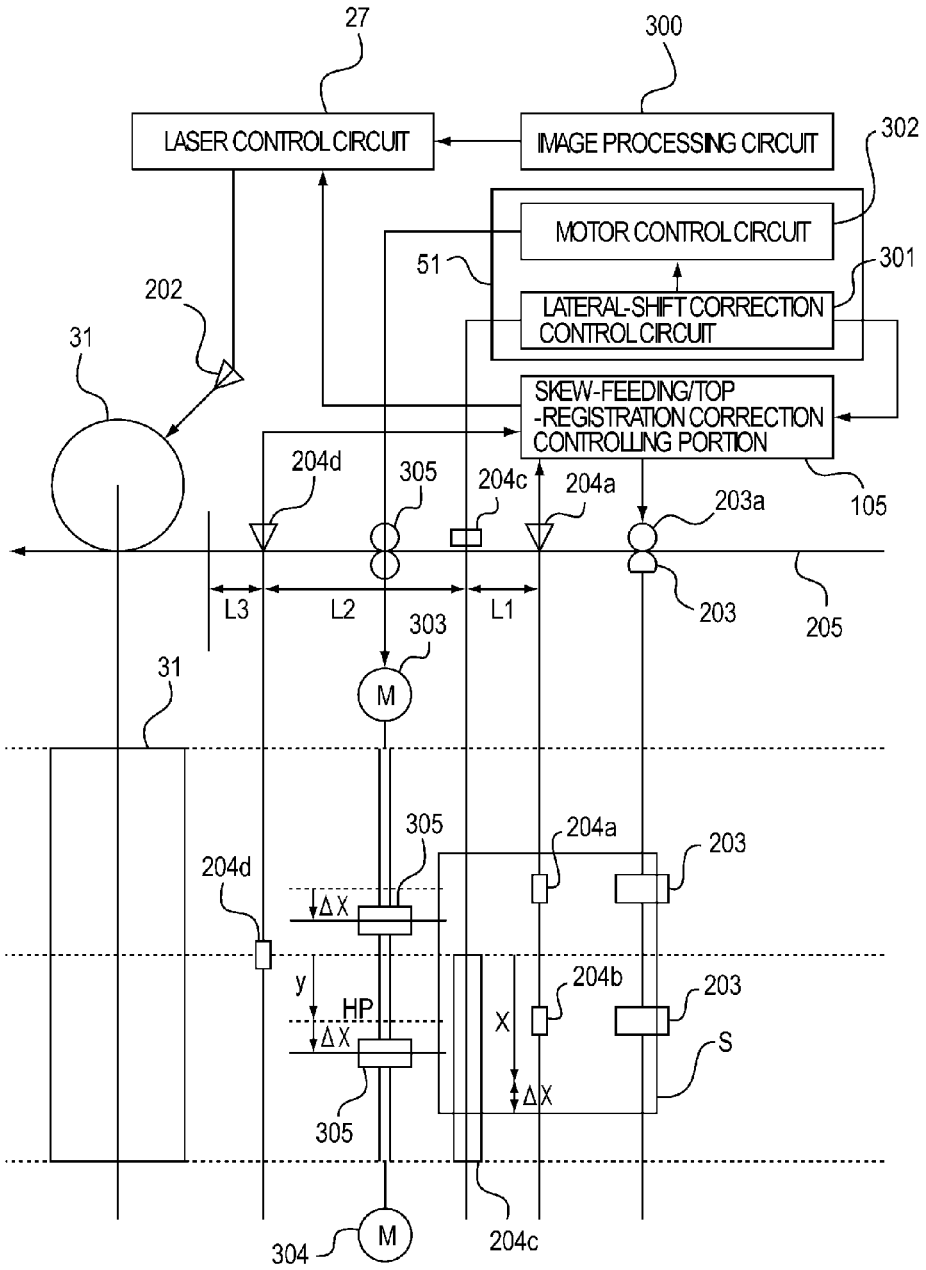
FIG. 11 is the first view which illustrates lateral-registration correction operation at the sheet correction portion.

Next, the lateral-registration shift operation according to the present embodiment will be described with reference to FIG. 11. FIG. 11 illustrates a state of a sheet S before receiving the lateral-registration shift correction. The sheet S is conveyed in a state of being deviated in the width direction by Δx after skew feeding thereof is corrected by the skew-feeding correcting roller 203. The sheet S conveyed in the state of being deviated in the width direction by Δx passes through the lateral-registration detection sensor 204*c*. At the time when the sheet S passes as described above, the lateral-registration controlling portion 51 (i.e., the lateral-shift correction control circuit 301) detects the lateral deviation occurring from the ideal value x assuming that the sheet S is conveyed without the lateral deviation occurrence. The ideal value x of the above is to be z/2. Here, z denotes length of the sheet S in the width direction. For example, in the case of using the sheet S of A4 size, the ideal value x is to be 148.5 mm since the length of the sheet S in the width direction is 297 mm. In the case of using the sheet S of B5R size, the ideal value x is to be 91 mm since the length of the sheet S in the width direction is 182 mm.

Figure 12:
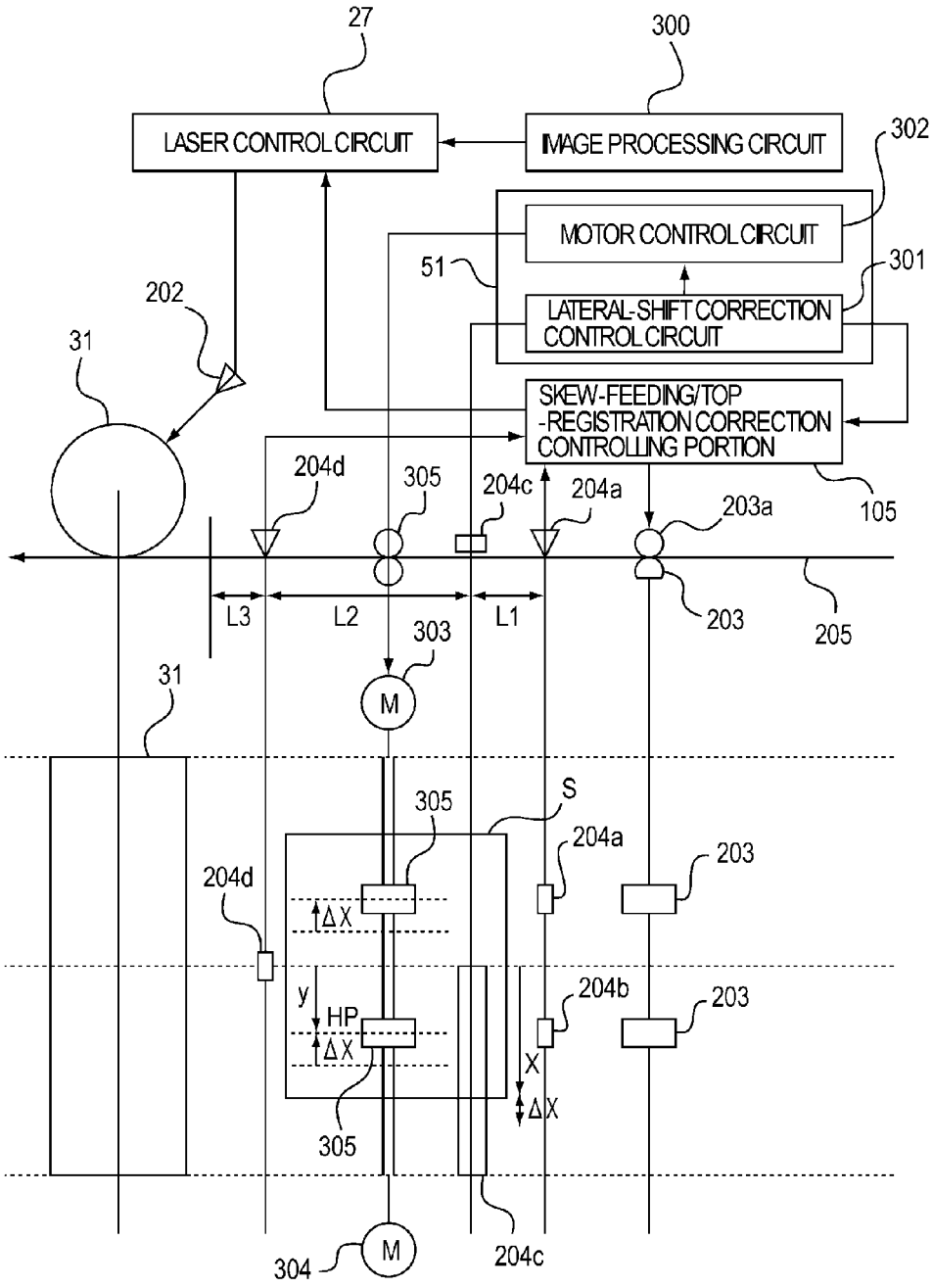
FIG. 12 is the second view which illustrates the lateral-registration correction operation at the sheet correction portion.

Next, after the deviation quantity Δx from the ideal value x is detected corresponding to the sheet size as described above, the lateral-registration controlling portion 51 shifts the pair of lateral-registration rollers 305 by Δx in the width direction via the motor control circuit 302. Here, the deviation quantity toward the front side of the sheet conveying path is expressed as +Δx and the deviation quantity toward the rear side of the sheet conveying path is expressed as −Δx. In the case illustrated in FIG. 11, the lateral deviation occurs toward the front side of the sheet conveying path. In this case, the pairs of lateral-registration rollers 305 are shifted by Δx so as to perform the lateral-registration correction on the sheet S. Consequently, the lateral-registration corrected as illustrated in FIG. 12 and a high quality image can be output.

Figure 13:
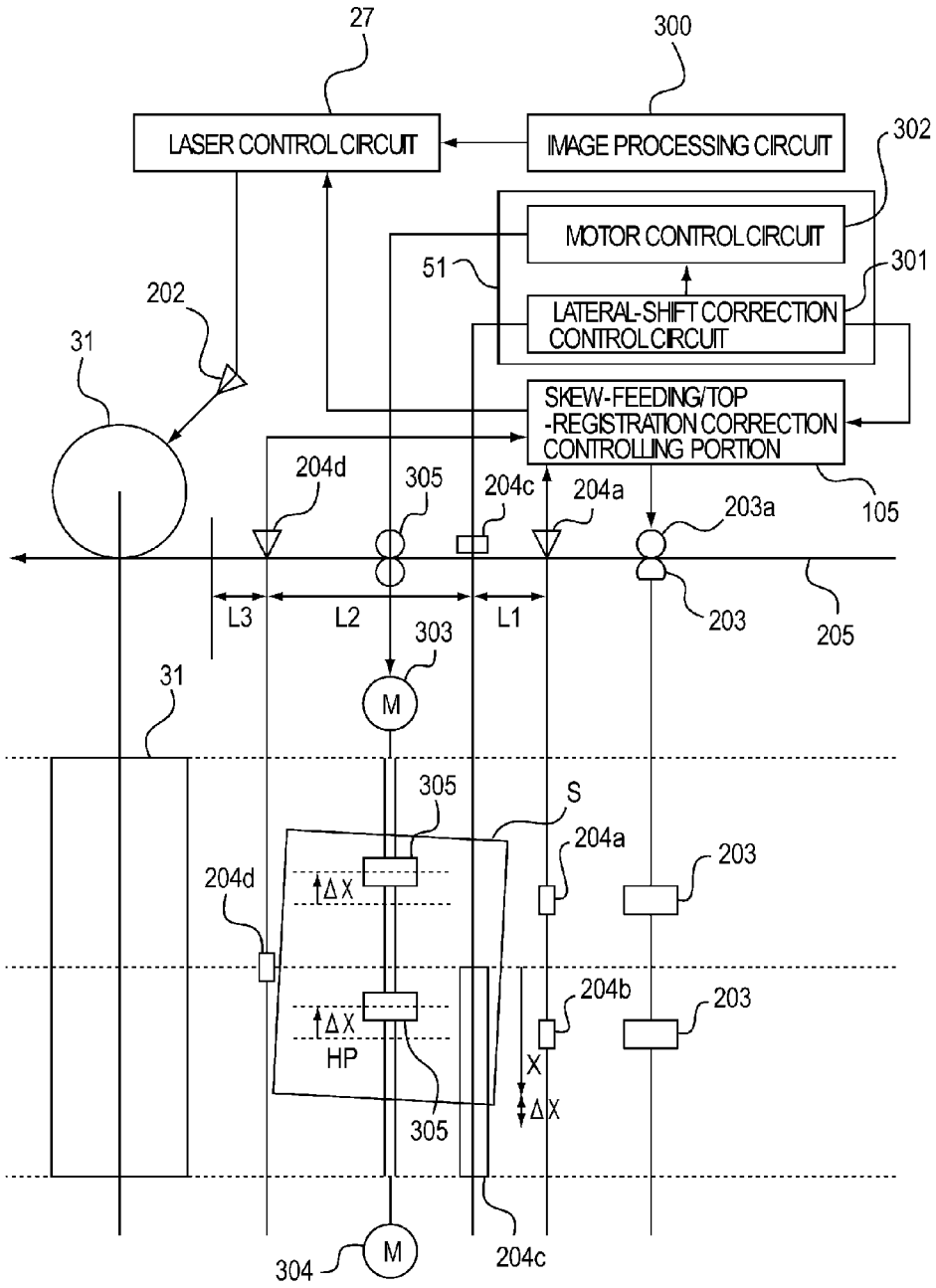
FIG. 13 is the third view which illustrates the lateral-registration correction operation at the sheet correction portion.

Here, when wearing occurs at the two pairs of lateral-registration rollers 305 due to deterioration with time, friction force of the pairs of lateral-registration rollers 305 is to be imbalanced against the sheet S during the lateral-shift operation. In this case, at the time of the lateral-shift to shift the pairs of lateral-registration rollers 305 in the width direction, skew feeding occurs at the sheet S as illustrated in FIG. 13. Accordingly, in the present embodiment, after the sheet lateral-registration is corrected by shifting the pairs of lateral-registration rollers 305 in the width direction, skew feeding at the sheet trailing edge is detected by the trailing edge skew-feeding detection portion 350 having the abovementioned configuration. Then, the trailing edge skew-feeding detection portion 350 outputs the detected skew-feeding quantity at the sheet trailing edge to the skew-feeding/top-registration correction control circuit 105. Here, the skew-feeding/top-registration correction control circuit 105 stores the output skew-feeding detection data in a memory portion (not illustrated) as offset data (i.e., adjustment data) of the skew-feeding correction for the next sheet and performs control having the offset data reflected at the time of skew-feeding correction for the next sheet. Accordingly, occurrence of the sheet skew feeding due to deterioration with time of the pairs of lateral-registration rollers 305 can be prevented in advance at the time of the lateral-shift operation. Consequently, stable shift operation can be performed.

Figure 14:
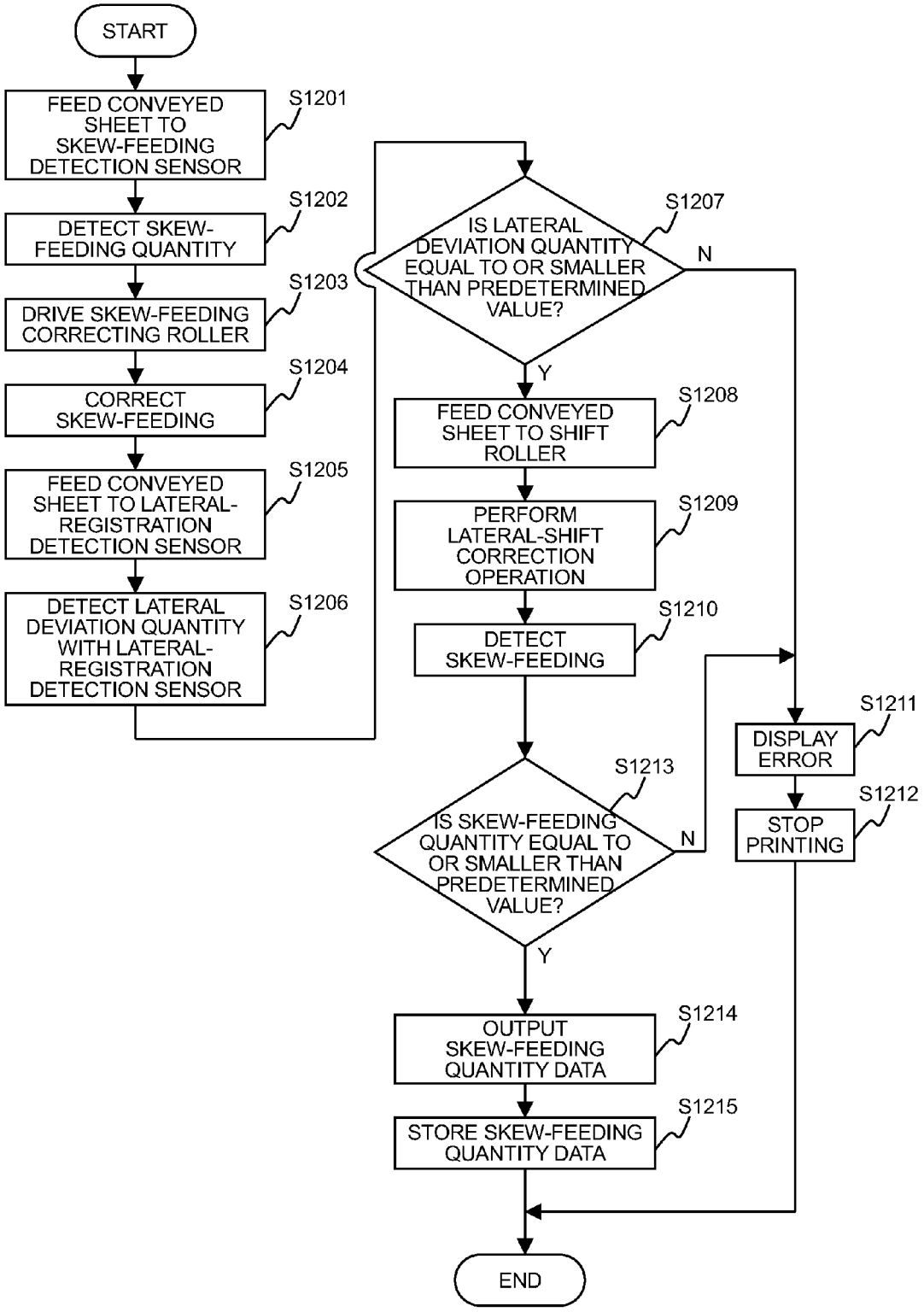
FIG. 14 is a flowchart which describes operation of skew-feeding correction and lateral-registration correction at the sheet correction portion.

Next, skew-feeding correction and the lateral-shift control in the present embodiment will be described with reference to a flowchart of FIG. 14. First, the conveyed sheet S is fed to the skew-feeding detection sensors 204*a* and 204*b* as illustrated in FIG. 2 (S1201), and then, the skew-feeding/top-registration correction controlling portion 105 detects by signals from the skew-feeding detection sensors the skew-feeding quantity at the sheet leading edge (S1202). Then, the skew-feeding/top-registration correction controlling portion 105 drives the skew-feeding correcting roller 203 corresponding to the detected skew-feeding quantity (S1203) and completes the skew-feeding correction operation (S1204). Next, the sheet S having the leading edge skew-feeding corrected by the skew-feeding correcting roller 203 is fed to the lateral-registration detection sensor 204*c* as illustrated in FIG. 11 (S1205). Then, when the sheet S is fed as described above, the lateral-registration detection sensor 204*c* outputs a detection signal and the lateral-registration controlling portion 51 (i.e., the lateral-shift correction control circuit 301) detects the lateral deviation quantity based on the detection signal from the lateral-registration sensor 204*c* (S1206). Here, when the detected lateral deviation quantity is equal to or smaller than a predetermined value ("Y" in step S1207), the sheet S is fed to the pair of lateral-registration rollers 305 thereafter (S1208) and the lateral-shift correction operation is performed (S1209) by shifting the pair of lateral-registration rollers 305 as driving the lateral shift motor 303.

When the lateral deviation quantity detected by the lateral-registration detection sensor 204*c* is out of the predetermined value ("N" in step S1207), error indication is performed (S1211) on a display portion (not illustrated) arranged at the copying machine body 1A as judging the lateral deviation quantity as being large. Then, the printing operation is stopped (S1212). Next, after completing the lateral-shift operation, skew feeding at the sheet trailing edge is detected by the lateral-registration detection sensor 204*c* (S1210). When the detected skew-feeding quantity at the sheet trailing edge is equal to or smaller than a predetermined value ("Y" in step S1213), the skew-feeding quantity data is output to the skew-feeding/top-registration correction controlling portion 105 (S1214) and the skew-feeding/top-registration correction controlling portion 105 stores the skew-feeding quantity data in the memory portion (S1215). When the skew-feeding quantity detected by the lateral-registration detection sensor 204*c* exceeds the predetermined value, that is, when the skew-feeding quantity is out of the predetermined value ("N" in step S1213), error indication is performed (S1211) as judging the skew-feeding quantity as being large and the printing operation (i.e., the image forming operation) is stopped (S1212).

Subsequently, when performing skew-feeding correction of the next sheet, the skew-feeding quantity at the sheet leading edge detected by the skew-feeding detection sensors 204*a* and 204*b* is adjusted with the skew-feeding quantity data stored in the detection memory portion. By adjusting the detected skew-feeding quantity at the sheet leading edge with the skew-feeding quantity data as described above, the correction can be performed more in advance by the skew-feeding quantity generated with the lateral-shift operation. For example, in the case that skew feeding occurs at a sheet as illustrated in FIG. 13 as described above during the lateral-shift correction operation, the skew-feeding correction quantity for correcting leading edge skew-feeding of the next sheet is enlarged by the amount to balance out the skew feeding due to the lateral-shift correction operation. As a result, the sheet arrives at the lateral-registration detection sensor 204*c* in a state with skew feeding for starting the lateral-shift correction operation. Then, when the pairs of lateral-registration rollers 305 are shifted, the sheet is shifted in the lateral direction while the skew feeding thereof is corrected. Accordingly, the sheet skew feeding is corrected simultaneously with completion of the lateral deviation correction. In this manner, even in the case that the pair of lateral-registration rollers 305 is deteriorated with time, sheet lateral deviation can be stably corrected without occurrence of skew feeding.

As described above, in the present embodiment, the skew-feeding quantity at the sheet trailing edge is detected after the lateral-shift operation is completed. Then, the detection result is fed back to the skew-feeding correction quantity of the skew-feeding correction portion for correcting skew feeding of the next sheet. That is, with the skew-feeding quantity of the sheet trailing edge detected after sheet positional deviation is corrected, the skew-feeding quantity to be detected for correcting skew feeding of the next sheet is to be adjusted. Accordingly, it is possible to prevent occurrence of sheet skew feeding accompanied with sheet lateral deviation correction caused by deterioration with time of the pair of lateral-registration rollers 305.

In the configuration of the above description, the lateral-registration detection sensor 204*c* also functions as the upstream edge skew-feeding quantity detection portion. However, the upstream edge skew-feeding quantity detection portion may be arranged separately. That is, the skew-feeding quantity detection portion may include a second sensor portion arranged at the downstream side in addition to a first sensor portion (i.e., the skew-feeding detection sensors 204*a* and 204*b*) at the upstream side arranged along the sheet conveying direction. Here, the first sensor portion detects the leading edge of the sheet to be conveyed and the second sensor portion detects the trailing edge of the sheet having skew-feeding correction performed by the skew-feeding correction portion.

Alternately, it is also possible to detect sheet skew feeding by continuously detecting sheet side edge positions with the lateral-registration detection sensor 204*c* and calculating the variation ratio of the detection result. Instead, it is also possible to detect sheet skew feeding with the variation ratio of the detection result and a previously-obtained experimental table of a relation between the variation ratio of the detection result and the skew-feeding quantity. When the sheet skew feeding is to be detected with the calculation and table as described above, it is also possible that the lateral-registration detection sensor 204*c* can be configured to also serve as the downstream edge skew-feeding quantity detection portion in addition to the upstream edge skew-feeding quantity detection portion. That is, the skew-feeding detection portion may include the lateral-registration detection sensor 204*c* being a single sensor portion and the lateral-registration detection sensor 204*c* may be configured to have functions of detecting the leading edge of the sheet to be conveyed and detecting the trailing edge of the sheet having skew feeding thereof corrected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-196774, filed Aug. 27, 2009, which is hereby incorporated by reference herein in its entirety.

What is claimed is:

1. An image forming apparatus comprising:

a detection unit configured to detect skew-feeding quantity and positional deviation quantity in a width direction of a sheet to be conveyed, the width direction being perpendicular to the sheet conveying direction;

a skew-feeding correction portion configured to correct skew feeding of a sheet to be conveyed;

a lateral deviation correction portion configured to correct positional deviation in the width direction of a sheet to be conveyed; and a controlling portion configured to control the skew-feeding correction portion and the lateral deviation correction portion, wherein the controlling portion controls the skew-feeding correction portion so as to correct sheet skew feeding based on the sheet skew-feeding quantity detected by the detection unit, controls the lateral deviation correction portion so as to correct positional deviation in the width direction of a sheet of which skew-feeding correction is performed at the skew-feeding correction portion based on the positional deviation quantity detected by the detection unit, and adjusts skew-feeding quantity for correcting skew feeding of the next sheet with the skew-feeding correction portion based on sheet skew-feeding quantity detected by the detection unit after positional deviation in the sheet width direction is corrected by the lateral deviation correction portion.

2. The image forming apparatus according to claim 1, wherein the detection unit comprises:

a skew-feeding quantity detection portion configured to detect skew-feeding quantity of a sheet to be conveyed; and a lateral deviation quantity detection portion configured to detect positional deviation quantity in a width direction of a sheet to be conveyed, the direction being perpendicular to the sheet conveying direction, and wherein the skew-feeding quantity detection portion includes one sensor portion having a function to detect the leading edge of a sheet to be conveyed and a function to detect the trailing edge of a sheet of which skew feeding is corrected by the skew-feeding correction portion.

3. The image forming apparatus according to claim 1, wherein the detection unit comprises:

a skew-feeding quantity detection portion configured to detect skew-feeding quantity of a sheet to be conveyed; and a lateral deviation quantity detection portion configured to detect positional deviation in a width direction of a sheet to be conveyed, the direction being perpendicular to the sheet conveying direction; and wherein the skew-feeding quantity detection portion includes a first sensor portion arranged at the upstream side and a second sensor portion arranged at the downstream side along the sheet conveying direction; and the first sensor portion detects the leading edge of a sheet to be conveyed and the second sensor portion detects the trailing edge of a sheet of which skew feeding is corrected by the skew-feeding correction portion.

4. The image forming apparatus according to claim 3, wherein the lateral deviation quantity detection portion also serves as the second sensor portion.

5. The image forming apparatus according to claim 3, wherein skew-feeding quantity at the upstream edge of a sheet in the sheet conveying direction is detected by the lateral deviation quantity detection portion after positional deviation in the sheet width direction is corrected by the lateral deviation correction portion, and skew-feeding quantity at the sheet leading edge detected by the first sensor portion for correcting skew feeding of the next sheet to be conveyed is adjusted with the detected skew-feeding quantity.

6. The image forming apparatus according to claim 3, wherein an image sensor is adopted as the lateral deviation quantity detection portion.

7. The image forming apparatus according to claim 1, wherein the skew-feeding correction portion includes a pair of rotating members which are arranged in a direction being perpendicular to the sheet conveying direction and controlled to be driven separately, the lateral deviation correction portion includes a pair of conveying rollers capable of conveying a sheet and shifting in the width direction in a state of nipping the sheet, and the controlling portion corrects sheet skew-feeding while conveying the sheet by creating a difference of a sheet conveying speed between the pair of rotating members based on the detected sheet skew-feeding quantity and adjusts positional deviation of the sheet by moving the pair of conveying rollers in the width direction in a state of nipping the sheet based on the detected positional deviation quantity.

8. The image forming apparatus according to claim 1, wherein image forming operation is stopped when the skew-feeding quantity at the upstream edge of a sheet in the sheet conveying direction detected by the detection unit exceeds a predetermined value.

9. The image forming apparatus according to claim 1, wherein the detection unit comprises:

a skew-feeding quantity detection portion configured to detect skew-feeding quantity of a sheet to be conveyed; and an image sensor configured to detect positional deviation quantity in a width direction of a sheet to be conveyed, the width direction being perpendicular to the sheet conveying direction and skew-feeding quantity of a trailing edge of a sheet to be conveyed, wherein the controlling portion controls the skew-feeding correction portion so as to correct sheet skew feeding based on the sheet skew-feeding quantity detected by the skew-feeding quantity detection portion, controls the lateral deviation correction portion so as to correct positional deviation in the width direction of a sheet of which skew-feeding correction is performed at the skew-feeding correction portion based on the positional deviation quantity detected by the image sensor, and adjusts skew-feeding correction quantity for correcting skew feeding of the next sheet with the skew-feeding correction portion based on sheet skew-feeding quantity detected by the image sensor after positional deviation in the sheet width direction is corrected by the lateral deviation correction portion.

* * * * *